US009608390B1

(12) United States Patent
Chen

(10) Patent No.: US 9,608,390 B1
(45) Date of Patent: Mar. 28, 2017

(54) CONNECTOR

(71) Applicant: HTC Corporation, Taoyuan (TW)

(72) Inventor: Wen-Yu Chen, Taoyuan (TW)

(73) Assignee: HTC Corporation, Taoyuan (TW)

( * ) Notice: Subject to any disclaimer, the term of this patent is extended or adjusted under 35 U.S.C. 154(b) by 0 days.

(21) Appl. No.: 14/880,277

(22) Filed: Oct. 12, 2015

(51) Int. Cl.
*H01R 24/00* (2011.01)
*H01R 24/60* (2011.01)
*H01R 107/00* (2006.01)

(52) U.S. Cl.
CPC ..... *H01R 24/60* (2013.01); *H01R 2107/00* (2013.01)

(58) Field of Classification Search
CPC ..... H01R 24/00; H01R 24/60; H01R 2107/00
USPC ..... 439/660, 676
See application file for complete search history.

(56) References Cited

U.S. PATENT DOCUMENTS

D722,967 S 2/2015 Yeh
2015/0207281 A1* 7/2015 Chien ..... H01R 24/62 439/676

FOREIGN PATENT DOCUMENTS

TW M480792 6/2014
TW M485544 9/2014
TW 201524022 6/2015

OTHER PUBLICATIONS

"Office Action of Taiwan Counterpart Application", issued on Jun. 20, 2016, p. 1-p. 7, in which the listed references were cited.

* cited by examiner

*Primary Examiner* — Khiem Nguyen
(74) *Attorney, Agent, or Firm* — Jianq Chyun IP Office

(57) ABSTRACT

A connector includes an insulating base, a plurality of pins and a metal enhancing plate. The insulating base has a first surface, a second surface and a side surface, wherein the first surface is opposite to the second surface, and the side surface is connected between the first surface and the second surface. The pins are disposed on the first surface and include a power pin, wherein a section of the side surface is aligned with the power pin. The metal enhancing plate is disposed on the second surface, wherein the metal enhancing plate does not extend to the section of the side surface.

8 Claims, 4 Drawing Sheets

CONNECTOR

BACKGROUND OF THE INVENTION

Field of the Invention

The present application relates to a connector, and more specifically relates to a connector having a power pin.

Description of Related Art

Recently, along with the daily development of industrial technologies, portable electronic devices such as notebook computer (NB), tablet computer, and smart phone, etc., are frequently used in everyday life. Types and functions of the portable electronic devices are increasingly diversified, and the portable electronic devices are more popular due to their convenience and practicality. The portable electronic devices are generally designed with I/O connector to recharge or to connect to other external devices.

If the external conductive substances (such as cotton containing water) are accumulated at the connector to cause unexpected conduction to be generated between the metal enhancing plate and the power pin of the connector, then the pins will generate heat to melt the connector when charging, so as to result in malfunction of the connector or to scald the user. Therefore, how to prevent unexpected conduction from being generated between the metal enhancing plate and the power pin of the connector is an important issue in designing the connector of the portable electronic devices.

SUMMARY OF THE INVENTION

The present application provides a connector which can prevent unexpected conduction from being generated between the metal enhancing plate and the power pin of the connector.

The connector of the present application includes an insulating base, a plurality of pins, and a metal enhancing plate. The insulating base has a first surface, a second surface and a side surface, wherein the first surface is opposite to the second surface, and the side surface is connected between the first surface and the second surface. The pins are disposed on the first surface and include a power pin, wherein a section of the side surface is aligned with the power pin. The metal enhancing plate is disposed on the second surface, wherein the metal enhancing plate does not extend to the section of the side surface.

The connector of the present application includes an insulating base, a plurality of pins, and a metal enhancing plate. The insulating base has a first surface, a second surface, and at least one first through hole, wherein the first surface is opposite to the second surface, and the first through hole is connected between the first surface and the second surface. The pins are disposed on the first surface and includes a power pin, wherein the power pin has two opposite side edges, at least one of the side edges faces another one of the pins, the first through hole is misaligned with the pins and the first through hole is not adjacent to each of the side edges of the power pin. The metal enhancing plate is disposed on the second surface.

Based on the above, in the connector of the present application, the metal enhancing plate does not extend to a section of the side surface of the insulating base, wherein this section is corresponding to the power pin. Therefore, when the external conductive substances are accumulated at the connector, the conductive substances are prevented from causing an unexpected conduction to be generated between the metal enhancing plate and the power pin via the side surface of the insulating base. In addition, the first through hole of the insulating base is not adjacent to each of the side edges of the power pin, so that the conductive substances are prevented from causing an unexpected conduction to be generated between the metal enhancing plate and the power pin via the first through hole of the insulating base. As a result, the connector will not malfunction or scald the user caused by the unexpected conduction, so as to have good reliability and safety.

In order to make the aforementioned and other features and advantages of the invention more comprehensible, embodiments accompanying figures are described in detail below.

DESCRIPTION OF THE EMBODIMENTS

Figure 1:
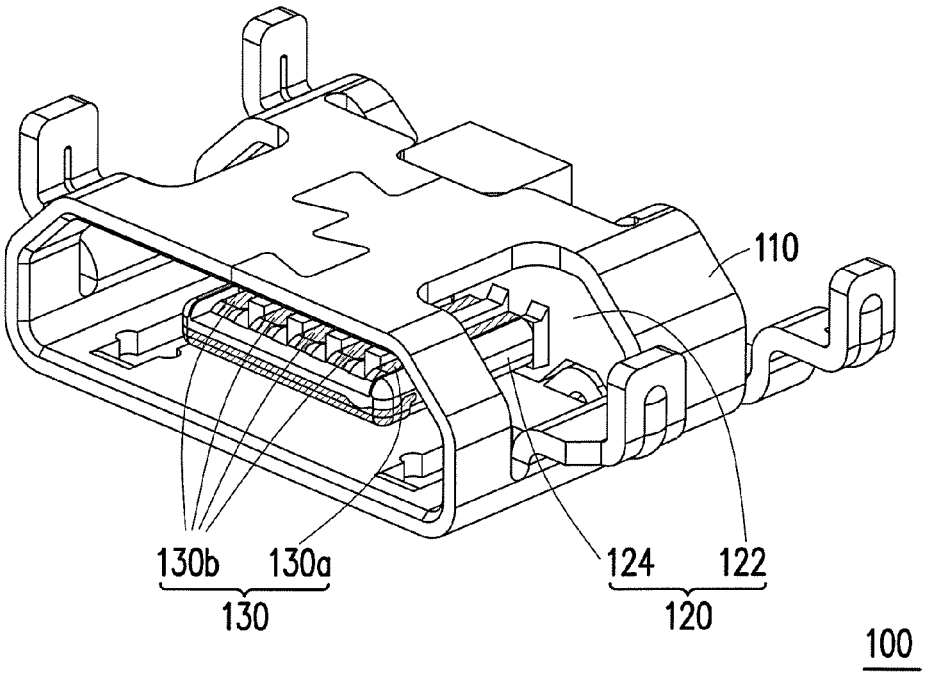
FIG. 1 is a three dimensional view of a connector of one embodiment of the invention.
Figure 2:
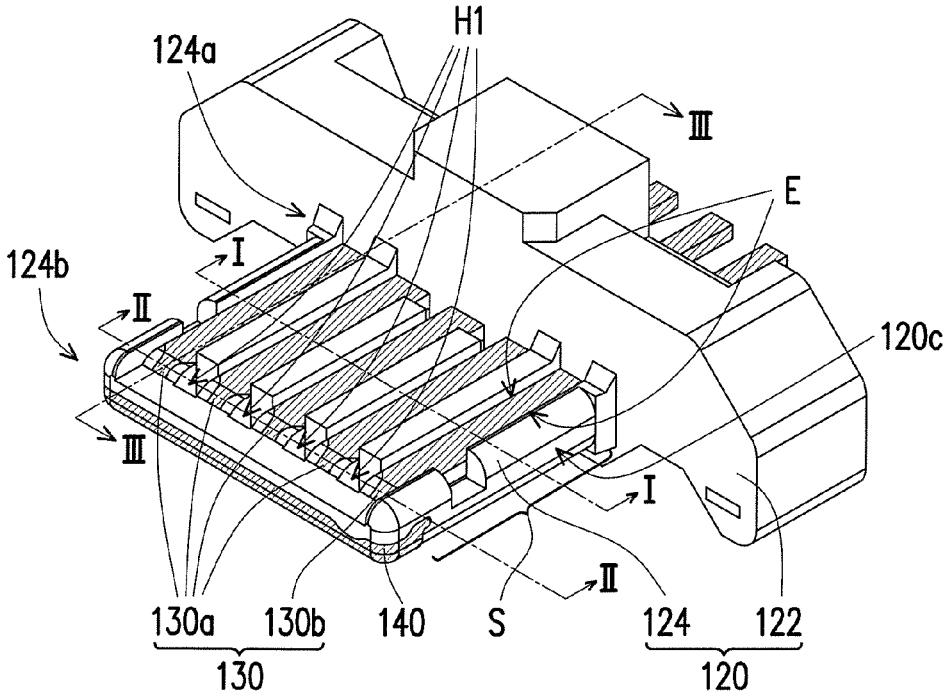
FIG. 2 is a three dimensional view of a part of components of the connector in FIG. 1.
Figure 3:
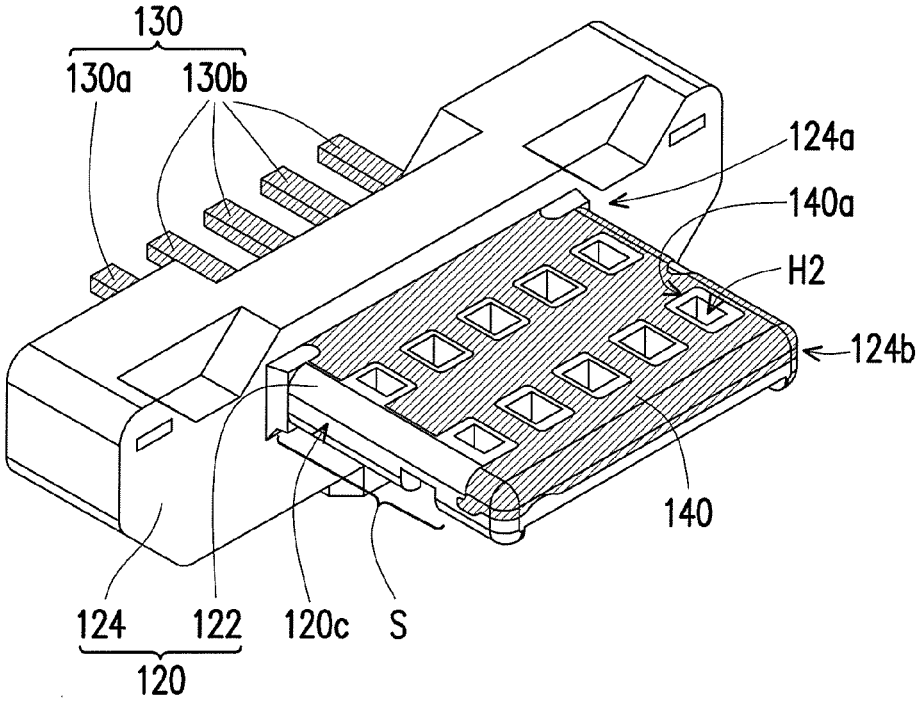
FIG. 3 is a three dimensional view at another angle of the connector in FIG. 2.

FIG. 1 is a three dimensional view of a connector of one embodiment of the invention. FIG. 2 is a three dimensional view of a part of components of the connector in FIG. 1. FIG. 3 is a three dimensional view at another angle of the connector in FIG. 2. Referring to FIGS. 1-3, the connector 100 of the present embodiment includes a metal housing 110, an insulating base 120, a plurality of pins 130, and a metal enhancing plate 140. The metal housing 110 covers the insulating base 120, the pins 130 are disposed at the insulating base 120, the metal enhancing plate 140 is, for example, used for structural reinforcement and disposed at the insulating base 120. In the present embodiment, the connector 100 is, for example, used as the connector in the universal serial bus (USB), the mini-USB, or micro-USB of the portable electronic device, but the present application is not limited thereto, the connector 100 may be used as the connector of other devices.

Figure 4:
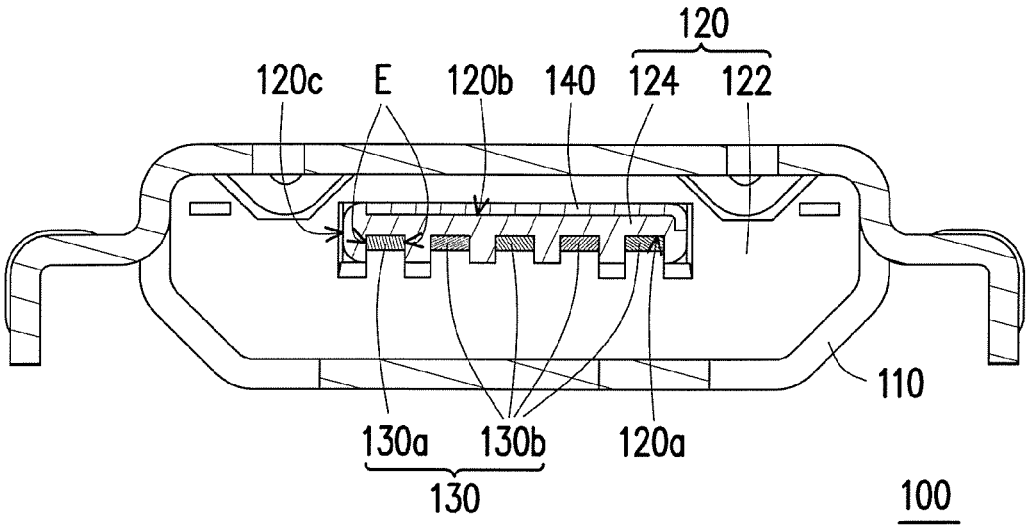
FIG. 4 is a cross-sectional view of the connector in FIG. 1.

FIG. 4 is a cross-sectional view of the connector in FIG. 1 along the section line I-I as depicted in FIG. 2. Referring to FIG. 2 and FIG. 4, the insulating base 120 of the present embodiment has a first surface 120*a*, a second surface 120*b*, and a side surface 120*c*, the first surface 120*a* is opposite to the second surface 120*b*, and the side surface 120*c* is connected between the first surface 120*a* and the second surface 120*b*. The pins 130 are disposed on the first surface 120*a* of the insulating base 120 and include a power pin 130*a* and other pins 130*b*, the pins 130*b* can include signal pin and grounding pin, but the present application is not limited thereto. A section S of the side surface 120*c* of the insulating base 120 is aligned with the power pin 130*a*, the metal enhancing plate 140 is disposed on the second surface 120*b* of the insulating base 120, and the metal enhancing plate 140 does not extend to the section S of the side surface 120*c*. Therefore, when the external conductive substances (such as moist cotton or other conductive substances) are accumulated at the connector 100, the conductive substances are prevented from causing an unexpected conduction to be generated between the metal enhancing plate 140 and the power pin 130*a* via the side surface 120*c* of the insulating base 120.

Figure 5:
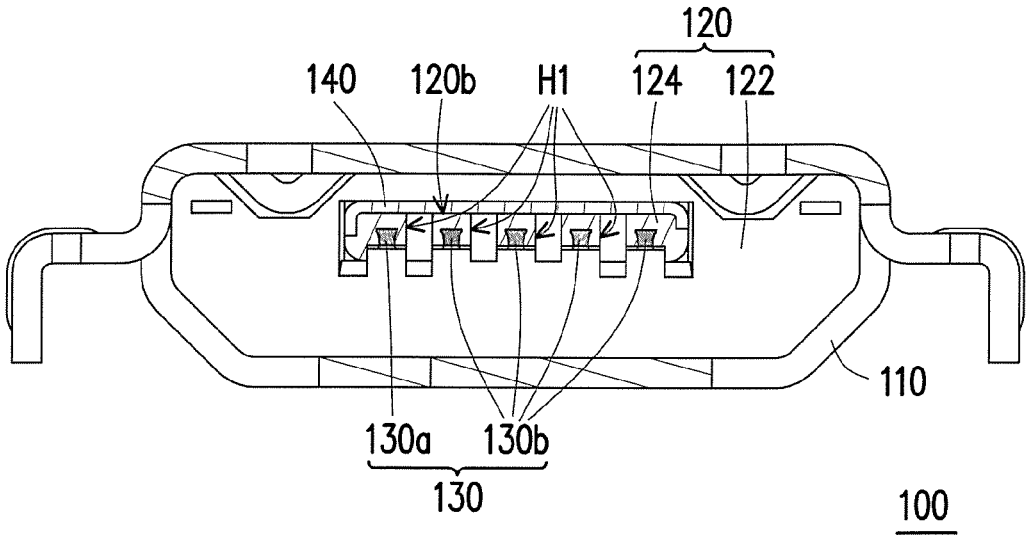
FIG. 5 is a cross-sectional view of the connector in FIG. 1.

FIG. 5 is a cross-sectional view of the connector in FIG. 1 along the section line II-II as depicted in FIG. 2. The insulating base 120 of the present embodiment is, for example, manufactured by injection molding process, wherein when the injection molding process is performed, for example, a plurality of columns are disposed inside the mold and lean against the metal enhancing plate 140, so as to fix the position of the metal enhancing plate 140. Therefore, after completing this injection molding process, the insulating base 120 has a plurality of first through holes H1 as shown in FIG. 2 and FIG. 5 corresponding to the columns, and the first through holes H1 are connected between the first surface 120*a* and the second surface 120*b* and misaligned with the pins 130. The power pin 130*a* has two opposite side edges E (as depicted in FIG. 2 and FIG. 4), wherein one side edge E faces another pin 130*b*, and the first through holes H1 are not adjacent to each of the side edges E of the power pin 130*a*. Therefore, the conductive substances are prevented from causing an unexpected conduction to be generated between the metal enhancing plate 140 and the power pin 130*a* via the first through holes H1 of the insulating base 120.

In the present embodiment, the insulating base 120 includes a fixed part 122 and an extension part 124 which are mutually connected, and the insulating base 120 is fixed to the metal housing 110 by the fixed part 122. The first surface 120*a* and the second surface 120*b* are formed on the extension part 124, that is, the pins 130 and the metal enhancing plate 140 are disposed on the extension part 124. Each of the pins 130 located at the extension part 124 is used to connect pins of an external connector, and each of the pins 130 passes through the fixed part 122 from the extension part 124 and protrudes beyond the fixed part 122, so as to connect to the electronic component inside the portable electronic device.

To be more specific, the extension part 124 of the insulating base 120 has a fixed end 124*a* (as depicted in FIG. 2) and a free end 124*b* (as depicted in FIG. 2) which are opposite to each other, the fixed end 124*a* is connected to the fixed part 122, and at least parts of the first through holes H1 is formed at the free end 124*b*. Because the free end 124*b* of the extension part 124 is adjacent to the exterior surface of the portable electronic device and thus the external conductive substances accumulated at the free end 124*b* can easily and automatically fall off, so that forming at least parts of the first through holes H1 at the free end 124*b* as above can further reduce the probability that unexpected conduction is generated by the conductive substances via the first through holes H1.

Figure 6:
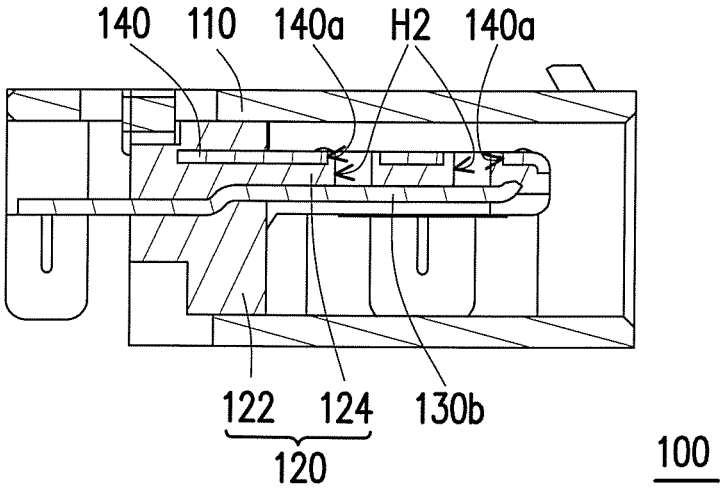
FIG. 6 is a cross-sectional view of the connector in FIG. 1.

FIG. 6 is a cross-sectional view of the connector in FIG. 1 along the section line III-III as depicted in FIG. 2. When using the injection molding process to manufacture the insulating base 120, for example, a plurality of columns are disposed in the mold and lean against the pins 130, so as to fix the locations of the pins 130. Therefore, after completing this injection molding process, the insulating base 120 has a plurality of second through holes H2 as shown in FIG. 3 and FIG. 6 corresponding to the columns, and the second through holes H2 are connected between the first surface 120*a* and the second surface 120*b* and aligned with the pins 130. The metal enhancing plate 140 has a plurality of openings 140*a*, the openings 140*a* are respectively aligned with the second through holes H2, the inner diameter of each of openings 140*a* is greater than the inner diameter of each of second through holes H2, so that the inner edge of each of the openings 140*a* and the corresponding second through hole H2 have a gap therebetween. Therefore, an appropriate gap is maintained between the metal enhancing plate 140 and each of the second through holes H2, so as to prevent the conductive substances from causing an unexpected conduction to be generated between the power pin 130*a* and the metal enhancing plate 140 via the second through holes H2.

In summary, in the connector of the present application, the metal enhancing plate does not extend to a section of the side surface of the insulating base, wherein this section is corresponding to the power pin. Therefore, when the external conductive substances are accumulated at the connector, the conductive substances are prevented from causing an unexpected conduction to be generated between the metal enhancing plate and the power pin via the side surface of the insulating base. In addition, the first through hole of the insulating base is not adjacent to each of the side edges of the power pin, so that the conductive substances are prevented from causing an unexpected conduction to be generated between the metal enhancing plate and the power pin via the first through hole of the insulating base. Further, the inner edge of the opening of the metal enhancing plate and the second through hole have a gap therebetween, so that the conductive substances are prevented from causing an unexpected conduction to be generated between the metal enhancing plate and the power pin via the second through holes of the insulating base. As a result, the connector will not malfunction or scald the user caused by the unexpected conduction, so as to have good reliability and safety.

Although the present invention has been described with reference to the above embodiments, it will be apparent to one of the ordinary skill in the art that modifications to the described embodiments may be made without departing from the spirit of the invention. Accordingly, the scope of the invention is defined by the attached claims not by the above detailed descriptions.

What is claimed is:

1. A connector, comprising:

an insulating base, having a first surface, a second surface, and a side surface, wherein the first surface is opposite to the second surface, and the side surface is connected between the first surface and the second surface;

a plurality of pins, disposed on the first surface and comprising a power pin, wherein a section of the side surface is aligned with the power pin; and a metal enhancing plate, disposed on the second surface, wherein the metal enhancing plate does not extend to the section of the side surface, and wherein the power pin has two opposite side edges, at least one of the side edges faces another one of the pins, the insulating base has at least one first through hole, the first through hole is connected between the first surface and the second surface and misaligned with the pins, the first through hole is not adjacent to each of the side edges of the power pin.

2. The connector as recited in claim 1, wherein the insulating base has at least one second through hole, the second through hole is connected between the first surface and the second surface and aligned with at least one of the pins, the metal enhancing plate has at least one opening, the opening is aligned with the second through hole, an inner edge of the opening and the second through hole have a gap therebetween.

3. The connector as recited in claim 1, wherein the insulating base comprises a fixed part and an extension part mutually connected, the first surface and the second surface are formed on the extension part, each of the pins passes through the fixed part from the extension part and protrudes beyond the fixed part.

4. The connector as recited in claim 3, wherein the extension part has a fixed end and a free end opposite to each other, the fixed end is connected to the fixed part, the first through hole is located at the free end.

5. A connector, comprising:

an insulating base, having a first surface, a second surface, and at least one first through hole, wherein the first surface is opposite to the second surface, and the first through hole is connected between the first surface and the second surface;

a plurality of pins, disposed on the first surface and comprising a power pin, wherein the power pin has two opposite side edges, at least one of the side edges faces another one of the pins, the first through hole is misaligned with the pins and is not adjacent to each of the side edges of the power pin; and a metal enhancing plate, disposed on the second surface.

6. The connector as recited in claim 5, wherein the insulating base has at least one second through hole, the second through hole is connected between the first surface and the second surface and aligned with at least one of the pins, the metal enhancing plate has at least one opening, the opening is aligned with the second through hole, an inner edge of the opening and the second through hole have a gap therebetween.

7. The connector as recited in claim 5, wherein the insulating base comprises a fixed part and an extension part mutually connected, the first surface and the second surface are formed on the extension part, each of the pins passes through the fixed part from the extension part and protrudes beyond the fixed part.

8. The connector as recited in claim 7, wherein the extension part has a fixed end and a free end opposite to each other, the fixed end is connected to the fixed part, the first through hole is located at the free end.

* * * * *